US010325557B2

(12) United States Patent
Cho

(10) Patent No.: US 10,325,557 B2
(45) Date of Patent: Jun. 18, 2019

(54) ORGANIC LIGHT-EMITTING DISPLAY APPARATUS

(71) Applicant: SAMSUNG DISPLAY CO., LTD., Yongin-si, Gyeonggi-do (KR)

(72) Inventor: Geunho Cho, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 230 days.

(21) Appl. No.: 15/359,998

(22) Filed: Nov. 23, 2016

(65) Prior Publication Data

US 2017/0148379 A1 May 25, 2017

(30) Foreign Application Priority Data

Nov. 23, 2015 (KR) ..... 10-2015-0163980

(51) Int. Cl.
*G09G 3/325* (2016.01)
*G09G 3/3266* (2016.01)

(52) U.S. Cl.
CPC ..... *G09G 3/325* (2013.01); *G09G 3/3266* (2013.01); *G09G 2300/043* (2013.01); *G09G 2300/0819* (2013.01); *G09G 2320/0233* (2013.01)

(58) Field of Classification Search
CPC ..... G09G 3/325; G09G 3/3266; G09G 2300/043; G09G 2320/0233; G09G 2300/0819
See application file for complete search history.

(56) References Cited

U.S. PATENT DOCUMENTS

2006/0038762 A1* 2/2006 Chou ..... G09G 3/325 345/92
2009/0251452 A1 10/2009 Kang et al.
2011/0157144 A1* 6/2011 Park ..... G09G 3/3233 345/212
2012/0019501 A1* 1/2012 Choi ..... G09G 3/3233 345/211
2014/0225075 A1* 8/2014 Zhan ..... H01L 29/78672 257/40
2014/0333597 A1 11/2014 Kim et al.
(Continued)

FOREIGN PATENT DOCUMENTS

KR 1020130074567 A 7/2013
KR 1020140062862 A 5/2014
(Continued)

*Primary Examiner* — Nitin Patel
*Assistant Examiner* — Amy Onyekaba
(74) *Attorney, Agent, or Firm* — Cantor Colburn LLP

(57) ABSTRACT

An organic light-emitting display apparatus includes an organic light-emitting diode ("OLED"), a driving transistor including a gate connected to a first node, and which supplies driving current to the OLED according to a voltage of the gate, a storage capacitor which is connected to the first node, and maintains a voltage of the first node constant, a switching transistor connected to the first node, and comprising a pair of transistors which are turned on at a same time according to a first control signal, and serially connected to each other via a second node, and a voltage level changer which is connected to the second node, and changes a voltage level of the second node to a reference voltage level after the switching transistor is turned off.

20 Claims, 11 Drawing Sheets

(56) References Cited

U.S. PATENT DOCUMENTS

| | | | | |
|---|---|---|---|---|
| 2015/0102336 | A1 | 4/2015 | Kang et al. | |
| 2017/0294162 | A1* | 10/2017 | Hu | G09G 3/3233 |
| 2017/0352316 | A1* | 12/2017 | Zhang | G09G 3/32 |

FOREIGN PATENT DOCUMENTS

| | | | |
|---|---|---|---|
| KR | 1020140102561 | A | 8/2014 |
| KR | 1020140132151 | A | 11/2014 |
| KR | 1020150044327 | A | 4/2015 |

* cited by examiner

ORGANIC LIGHT-EMITTING DISPLAY APPARATUS

This application claims priority to Korean Patent Application No. 10-2015-0163980, filed on Nov. 23, 2015, and all the benefits accruing therefrom under 35 U.S.C. § 119, the content of which in its entirety is herein incorporated by reference.

BACKGROUND

1. Field

One or more exemplary embodiments relate to an organic light-emitting display apparatus, and more particularly, to a pixel circuit in an organic light-emitting display apparatus.

2. Description of the Related Art

An organic light-emitting display apparatus includes an organic light-emitting diode ("OLED") having luminance that varies according to current. A pixel in the organic light-emitting display apparatus includes an OLED, a driving transistor for controlling an amount of current supplied to the OLED according to a voltage between a gate and a source of the driving transistor, and a switching transistor for transmitting a data voltage for controlling luminance of the OLED to the driving transistor. A voltage between the gate and the source of the driving transistor may need to be maintained constant so as to maintain a constant luminance of the OLED in a frame. A pixel further includes a storage capacitor connected to the gate of the driving transistor, so as to maintain the voltage to be constant between the gate and the source of the driving transistor.

A size of an organic light-emitting display apparatus is gradually increased and a resolution of the organic light-emitting display apparatus is also increased, so as to display a vivid image. Additionally, there is a demand for an organic light-emitting display apparatus having high luminance in a bright part of an image and low luminance in a dark part of the image, so as to enhance a contrast of the image.

SUMMARY

In enhancing a contrast of an image, a problem where voltages at both ends of a storage capacitor are greatly changed due to noise such as a logical level transition of a gate signal or a transistor-off current may occur. Resultantly, a problem where luminance of an organic light-emitting display is changed in a frame may occur.

One or more exemplary embodiments include an organic light-emitting display apparatus including a pixel circuit for constantly maintaining voltages at both ends of a storage capacitor in a pixel.

One or more exemplary embodiments include an organic light-emitting display apparatus including a pixel circuit for relieving stress that may be caused by a difference in voltages at both ends of a transistor, and reducing leak current that may occur when the transistor is off.

Exemplary embodiments may be embodied in many different forms and should not be construed as being limited to the embodiments set forth herein. Additional exemplary embodiments will be set forth in part in the description which follows and, in part, will be apparent from the description, or may be learned by practice of the presented embodiments.

According to one or more exemplary embodiments, an organic light-emitting display apparatus includes an organic light-emitting diode ("OLED"), a driving transistor including a gate connected to a first node, and supplies driving current to the OLED according to a voltage of the gate, a storage capacitor which is connected to the first node, and maintains a voltage of the first node constant, a switching transistor connected to the first node, and including a pair of transistors which are turned on at a same time according to a first control signal, and serially connected to each other via a second node, and a voltage level changer which is connected to the second node, and changes a voltage level of the second node to a reference voltage level after the switching transistor is turned off.

According to one or more exemplary embodiments, an organic light-emitting display apparatus includes an OLED, a driving transistor which outputs driving current to the OLED, a storage capacitor which charges a voltage corresponding to a data signal that is supplied via a data line, a scanning transistor which transmits the data signal, supplied via the data line, to a source of the driving transistor in response to a first control signal, first and second switching transistors which connect a gate of the driving transistor to a drain of the driving transistor, in response to the first control signal at a same time, and serially connected to each other via a connection node, and a voltage level changer which is connected to the connection node, and changes a voltage level of the connection node to a reference voltage level after the first and second switching transistors are turned off.

BRIEF DESCRIPTION OF THE DRAWINGS

These and/or other exemplary embodiments will become apparent and more readily appreciated from the following description of the exemplary embodiments, taken in conjunction with the accompanying drawings, in which.

DETAILED DESCRIPTION

Figure 1:
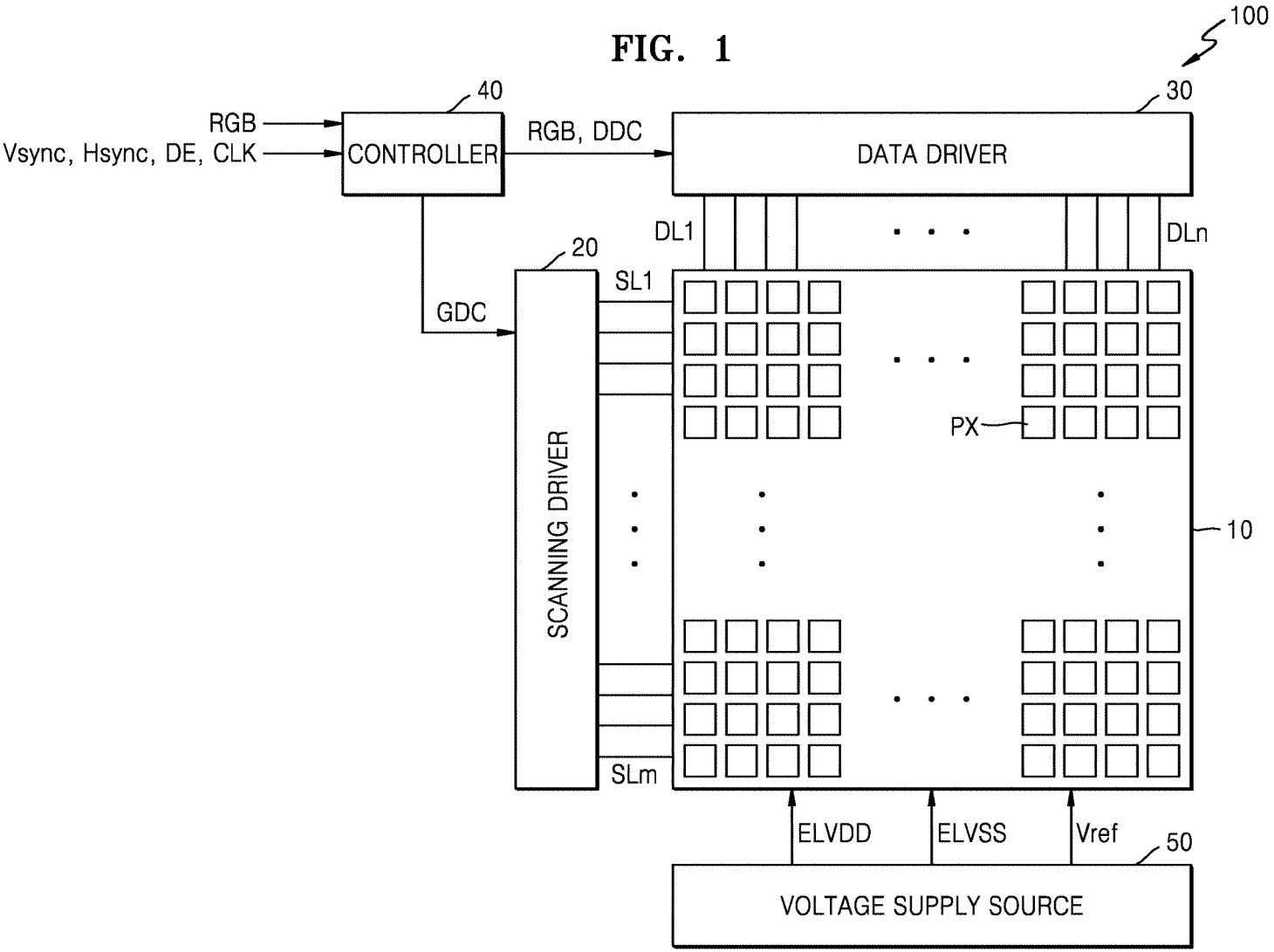
FIG. 1 is a block diagram of an exemplary embodiment of an organic light-emitting display apparatus.

Reference will now be made in detail to exemplary embodiments, examples of which are illustrated in the accompanying drawings, where like reference numerals refer to like elements throughout. In this regard, the exemplary embodiments may have different forms and should not be construed as being limited to the descriptions set forth herein. Accordingly, the exemplary embodiments are merely described below, by referring to the figures, to explain exemplary embodiments of the description. As used herein, the term "and/or" includes any and all combinations of one or more of the associated listed items. Expressions such as "at least one of", when preceding a list of elements, modify the entire list of elements and do not modify the individual elements of the list.

As exemplary embodiments allow for various changes and numerous embodiments, particular embodiments will be illustrated in the drawings and described in detail in the written description. Effects and features of the exemplary embodiments and a method of achieving the same will become apparent to those skilled in the art from the following detailed description which discloses various embodiments in conjunction with the annexed drawings. The exemplary embodiments may, however, be embodied in many different forms and should not be construed as being limited to the embodiments set forth herein.

Hereinafter, exemplary embodiments will be described in detail with reference to the attached drawings. In the description of the invention, certain detailed explanations of the related art are omitted when it is deemed that they may unnecessarily obscure the essence of the invention. Like reference numerals in the drawings denote like or corresponding elements, and thus their descriptions will not be repeated.

It will be understood that although the terms "first", "second", etc. may be used herein to describe various components, these components should not be limited by these terms. These components are only used to distinguish one component from another. As used herein, the singular forms "a," "an" and "the" are intended to include the plural forms as well, unless the context clearly indicates otherwise. It will be understood that when an element is referred to as being "connected to" or "coupled to" another element, it may be "directly connected or coupled" to the other element, or "electrically connected to" the other element with intervening elements therebetween. It will be further understood that the terms "comprises", "comprising", "includes", and/or "including" when used herein, specify the presence of components, but do not preclude the presence or addition of one or more other components, unless otherwise specified.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram of an organic light-emitting display apparatus 100, according to an exemplary embodiment.

Referring to FIG. 1, the organic light-emitting display apparatus 100 may include a display 10, a scanning driver 20, a data driver 30, a controller 40, and a voltage supply source 50.

The display 10 may include a plurality of pixels PX arranged in a form of a matrix. The plurality of pixels PX may include an organic light-emitting diode ("OLED"), a driving transistor that has a gate connected to a first node and supplies driving current to the OLED according to a voltage of the gate, a storage capacitor that is connected to the first node and maintains a voltage of the first node constant, a switching transistor that is connected to the first node and includes a pair of transistors, which are turned on according to a first control signal at a same time and serially connected to each other via a second node, and a voltage level changer that is connected to the second node and changes a voltage level of the second node to a reference voltage level after the switching transistor is turned off.

A pixel PX may be connected to a scanning line corresponding to the pixel PX, among scanning lines SL1 through SLm, and a data line corresponding to the pixel PX, among data lines DL1 through DLn. The scanning lines SL1 through SLm may transmit control signals, output from the scanning driver 20, to pixels PX on the same rows as the scanning lines SL1 through SLm, respectively, and the data lines DL1 through DLn may transmit data voltages, output from the data driver 30, to pixels PX on the same columns as the data lines DL1 through DLn, respectively. FIG. 1 shows each of the scanning lines SL1 through SLm as a line. However, each of the scanning lines SL1 through SLm may include a plurality of lines for transmitting a plurality of control signals in parallel with each other, according to pixels PX.

A first driving voltage ELVDD, a second driving voltage ELVSS, and a reference voltage Vref from the voltage supply source 50 may be applied to the plurality of pixels PX. The first driving voltage ELVDD and the second driving voltage ELVSS are driving voltages by which an OLED of a pixel PX emits light, and a voltage level of the first driving voltage ELVDD may be higher than a voltage level of the second driving voltage ELVSS. The reference voltage Vref is a voltage used to operate a pixel PX, and may have a voltage level similar to that of the second driving voltage ELVSS. The reference voltage Vref may be referred to as an initialization voltage Vinit according to pixels PX.

A pixel PX may control the amount of current flowing from the first driving voltage ELVDD to the second driving voltage ELVSS via the OLED, based on a data voltage transmitted via a data line corresponding to the pixel PX. A data voltage may refer to a signal transmitted via a data line corresponding to a pixel or a voltage level of the signal. An OLED of a pixel PX may emit light with luminance corresponding to the data voltage. A pixel PX may refer to a sub-pixel that is a part of a pixel that may display full colors, a group of sub-pixels that are references for displaying a resolution, or a pixel outputting light of a single color (e.g., white).

A vertical synchronization signal Vsync, a horizontal synchronization signal Hsync, a data enable signal DE, a clock signal CLK, and a data signal RGB from outside may be applied to the controller 40. The controller 40 may control operation timings of the scanning driver 20 and the data driver 30, using a timing signal such as the vertical synchronization signal Vsync, the horizontal synchronization signal Hsync, the data enable signal DE, or the clock signal CLK. Since the controller 40 may determine a period of a frame by counting data enable signals DE in a horizontal scanning period, the vertical synchronization signal Vsync and the horizontal synchronization signal Hsync, which are supplied from outside, may be omitted. The data signal RGB may include luminance information of the plurality of pixels PX. In an exemplary embodiment, luminance may include a determined number of grays, for example, 1024, 256, or 64 grays, for example.

The controller 40 may generate a gate timing control signal GDC for controlling an operational timing of the scanning driver 20, and a data timing control signal DDC for controlling an operational timing of the data driver 30.

The gate timing control signal GDC may include a gate start pulse ("GSP") signal, a gate shift clock ("GSC") signal, a gate output enable ("GOE") signal, or the like. The GSP signal may be supplied to the scanning driver 20 from which a first scan signal is generated. The GSC signal is a clock signal that is input to the scanning driver 20, and may be a clock signal for shifting the GSP signal. The GOE signal may control output from the scanning driver 20.

The data timing control DDC signal may include a source start pulse ("SSP") signal, a source sampling clock ("SSC") signal, a source output enable ("SOE") signal, or the like. The SSP signal may be a signal for controlling a time point at which the data driver 30 starts data sampling. The SSC signal may be a clock signal for controlling operation of sampling data in the data driver 30, with reference to a rising edge, a falling edge, or a particular flat voltage. The SOE signal may be a signal for controlling output from the data driver 30. The SSP signal, supplied to the data driver 30, may be omitted according to a data transmission method.

The scanning driver 20 may sequentially generate control signals for operating transistors in the plurality of pixels PX included in the display 10, in response to the gate timing control signal GDC supplied from the controller 40. The scanning driver 20 may supply control signals to the plurality of pixels PX included in the display 10, via the scanning lines SL1 through SLm. According to a design of the plurality of pixels PX, a plurality of control signals may be provided to a pixel PX. In an exemplary embodiment, first through fourth control signals may be provided to a pixel PX in a frame, according to a predetermined order of signals, for example.

The data driver 30 may sample and latch a data signal RGB in digital form, which is supplied from the controller 40, in response to the data timing control signal DDC supplied from the controller 40, and thus, convert the data signal RGB in digital form into data in a parallel data system. When the data driver 30 converts the data signal RGB in digital form into data in the parallel data system, the data driver 30 may convert the data signal RGB in digital form into a data voltage in analog form using a gamma reference voltage. The data driver 30 may supply a data voltage to the plurality of pixels PX included in the display 10 via the data lines DL1 through DLn.

Hereinafter, according to one or more exemplary embodiments, pixels are described in detail.

Figure 2:
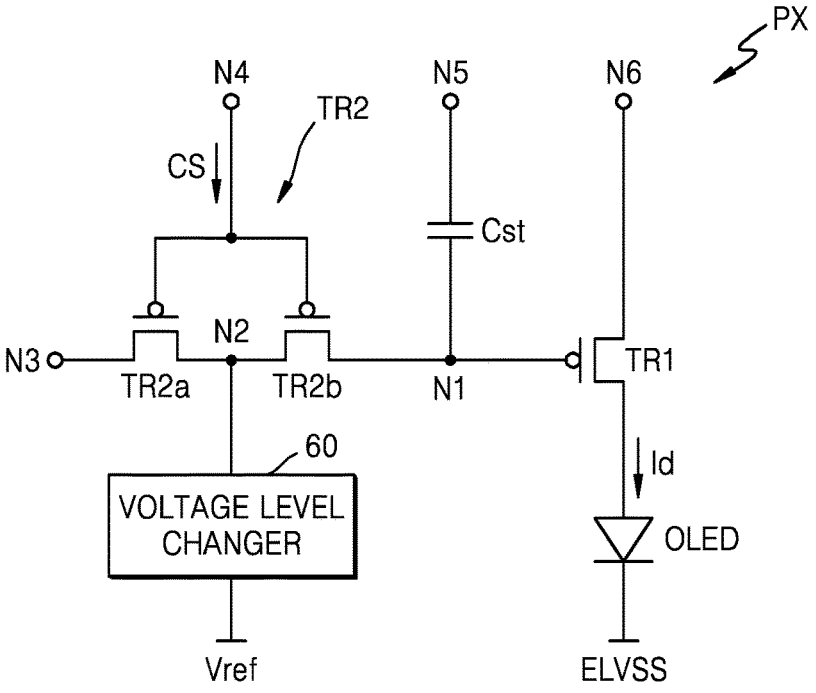
FIG. 2 is a block diagram of an exemplary embodiment of a pixel.

FIG. 2 is a block diagram of a pixel PX according to an exemplary embodiment.

Referring to FIG. 2, the pixel PX may include an OLED, first and second transistors TR1 and TR2, a storage capacitor Cst, and a voltage level changer 60.

The first transistor TR1 may include a gate connected to a first node N1, and may supply driving current Id to the OLED according to a voltage of the gate of the first transistor TR1. A magnitude of the driving current Id is determined by a gate-source voltage of the first transistor TR1. However, when a source voltage of the first transistor TR1 is fixed, a magnitude of the driving current Id may be controlled by a gate voltage of the first transistor TR1. The first transistor TR1 may be referred to as a driving transistor.

The first transistor TR1 may include a drain connected to an anode of the OLED, and a source connected to a sixth node N6. A first driving voltage ELVDD may be applied to the sixth node N6.

The storage capacitor Cst is connected between the first node N1 and a fifth node N5, and a voltage of the first node N1, that is, a gate voltage of the first transistor TR1 may be maintained constant. The storage capacitor Cst may maintain a gate voltage of the first transistor TR1 in a frame constant, for example, in a light emission period that comes after a data write period. Resultantly, the first transistor TR1 may supply constant driving current Id to the OLED in the light emission period, and the OLED may emit light with constant luminance. The fifth node N5 may be connected to a source of the first transistor TR1, that is, the sixth node N6. That is, the first driving voltage ELVDD having a certain magnitude may be applied to the fifth node N5.

The second transistor TR2 is connected between the first node N1 and a third node N3, and may be controlled by a control signal CS provided via a fourth node N4. The second transistor TR2 may include a pair of transistors TR2*a* and TR2*b* which are controlled by the control signal CS at a same time, and serially connected to each other. Gates of the pair of transistors TR2*a* and TR2*b* may be directly connected to each other. A node between the pair of transistors TR2*a* and TR2*b* may be defined as a second node N2. The pair of transistors TR2*a* and TR2*b* may be connected to each other via the second node N2. The second transistor TR2 may be referred to as a switching transistor.

As shown in FIG. 2, the second transistor TR2 may be a p-type metal-oxide-semiconductor field-effect transistor ("MOSFET"). The second transistor TR2 may be turned off when a high level of the control signal CS is applied to the second transistor TR2 via the fourth node N4, and turned on when a low level of the control signal CS is applied to the second transistor TR2 via the fourth node N4. A high level of a signal may be referred to as a turn-off level, and a low level of a signal may be referred to as a turn-on level. However, exemplary embodiments are not limited thereto, and may also be applied to a case when the second transistor TR2 is an n-type MOSFET.

When a transistor is turned off, current passing through the transistor may be ideally zero. However, even when a transistor is actually turned off, current passing through the transistor is not zero, and current passing through a transistor even when the transistor is turned off may be referred to as turn-off current or leakage current. Since the second transistor TR2 includes the pair of transistor TR2*a* and TR2*b*, which are serially connected to each other, the turn-off current may be low. Accordingly, a very small amount of electric charges, among electric charges stored in the storage capacitor Cst, is discharged via the second transistor TR2, and a gate voltage of the first transistor TR1 may be maintained constant.

As a size of the pixel PX is decreased, an area of the storage capacitor Cst is also decreased. Accordingly, a capacity of the storage capacitor Cst is decreased. Thus, even when a small amount of turn-off current flows into the storage capacitor Cst, a voltage at both edges of the storage capacitor Cst may be greatly changed. Resultantly, a gate voltage of the first transistor TR1 may be changed, and thus, luminance of the OLED may be changed.

When the second transistor TR2 is a p-type MOSFET, the second transistor TR2 may be turned off in response to a rising edge or a high flat voltage of the control signal CS. When the second transistor TR2 is turned off, since the transistors TR2*a* and TR2*b* at both sides of the second node N2 are turned off, the second node N2 may be substantially floated. Due to characteristics of a MOSFET, there may be parasitic capacitance between the second node N2 and gates of the transistors TR2*a* and TR2*b*. In other words, when the second node N2 is floated, in case where electric potentials of the gates of the transistors TR2*a* and TR2*b* are changed, an electric potential of the second node N2 may be changed according to the electric potentials of the gates of the transistors TR2*a* and TR2*b* by the parasitic capacitance. Since the control signal CS is directly applied to the gates of the pair of the transistors TR2*a* and TR2*b*, the second node N2 is coupled to a rising edge or a high flat voltage of the control signal CS by the parasitic capacitance. When the second transistor TR2 is turned off, an electric potential of the second node N2 may increase in correspondence with the rising edge or the high flat voltage of the control signal CS.

The control signal CS is a signal for controlling the second transistor TR2, and a voltage of the control signal CS may be changed by about 20 volts (V). Accordingly, when the second transistor TR2 is turned off, an electric potential of the second node N2 may increase, for example, by about 20 V. The electric potential of the second node N2 may be higher than an electric potential of the first node N1. Particularly, when the OLED emits light with luminance corresponding to a full-white state, a voltage between the first node N1 and the second node N2, of which electric potential is increased, may be about 20 V. In this case, when a voltage between a source and a drain of the transistor TR2*b* is as high as about 20 V, even when the transistor TR2*b* is turned off, an unignorable magnitude of turn-off current may flow from the second node N2 to the first node N1 and excessive stress may occur in the transistor TR2*b* due to a high voltage. Additionally, when an additional circuit is connected to the third node N3, even when the other transistor TR2*a* is turned off, leak current may be generated from the second node N2 to the third node N3 and excessive stress may occur in the transistor TR2*a* due to a high voltage. Additionally, a voltage of the first node N1 may increase due to turn-off current from the second node N2, and the driving current Id may decrease due to an increase in a gate voltage of the first transistor TR1, and accordingly, luminance of the OLED may decrease.

In the above-described exemplary embodiment, the voltage level changer 60, which may change a voltage level of the second node N2 to a level of a reference voltage Vref, may be connected to the second node N2. The voltage level changer 60 may change the voltage level of the second node N2 to the level of the reference voltage Vref after the second transistor TR2 is turned off. When the second transistor TR2 is turned off, the voltage level of the second node N2, which is substantially floated in correspondence with a rising edge or a high flat voltage of the control signal CS, may increase. The increase in the voltage level of the second node N2 may be caused by accumulation of electric charges in a parasitic capacitor between the second node N2 and the gates of the transistors TR2*a* and TR2*b*. The voltage level changer 60 may decrease a voltage level of the second node N2, which is increased by the parasitic capacitor, to a level of the predetermined reference voltage Vref. The voltage level changer 60 may include a voltage level changing transistor, which applies the reference voltage Vref to the second node N2.

The level of the reference voltage Vref may be determined as a value that is less than a range of a voltage level that the first node N1 may have. In this case, when the voltage level of the second node N2 is changed to a level of the predetermined reference voltage Vref according to operation of the voltage level changer 60, a phenomenon in which turn-off current flows into the first node N1 via the transistor TR2*b* may be prevented.

As an example, the third node N3 may be connected to a data line for transmitting a data voltage to the third node N3, and the fourth node N4 may be connected to a scanning line for transmitting a scanning signal to the fourth node N4. The second transistor TR2 may transmit the data voltage, received by the third node N3, to the first node N1 in response to a scanning signal received by the fourth node N4. In this case, the second transistor TR2 may be referred to as a scanning transistor.

In another exemplary embodiment, the third node N3 may be connected to a drain of the first transistor TR1, and the fourth node N4 may be connected to the scanning line for transmitting the scanning signal to the fourth node N4. The second transistor TR2 may diode-connect the first transistor TR1 by electrically connecting the gate of the first transistor TR1 to the drain of the first transistor TR1 in response to a scanning signal received by the fourth node N4. The second transistor TR2 may diode-connect the first transistor TR1 so that a compensation voltage in which a threshold voltage of the first transistor TR1 is reflected may be stored in the storage capacitor Cst. In this case, the second transistor TR2 may be referred to as a compensation transistor.

According to exemplary embodiments, all transistors may be a positive, negative, positive ("PNP")-type transistor, for example. In other words, the first transistor TR1, the second transistor TR2, and other various transistors that are to be described later may be PNP-type transistors. However, this is only an exemplary embodiment, and according to other exemplary embodiments, all transistors described herein may be negative, positive, and negative ("NPN")-type transistors, for example. In an alternative exemplary embodiment, some transistors may be implemented as PNP-type transistors, and other transistors may be implemented as NPN-type transistors.

Figure 3:
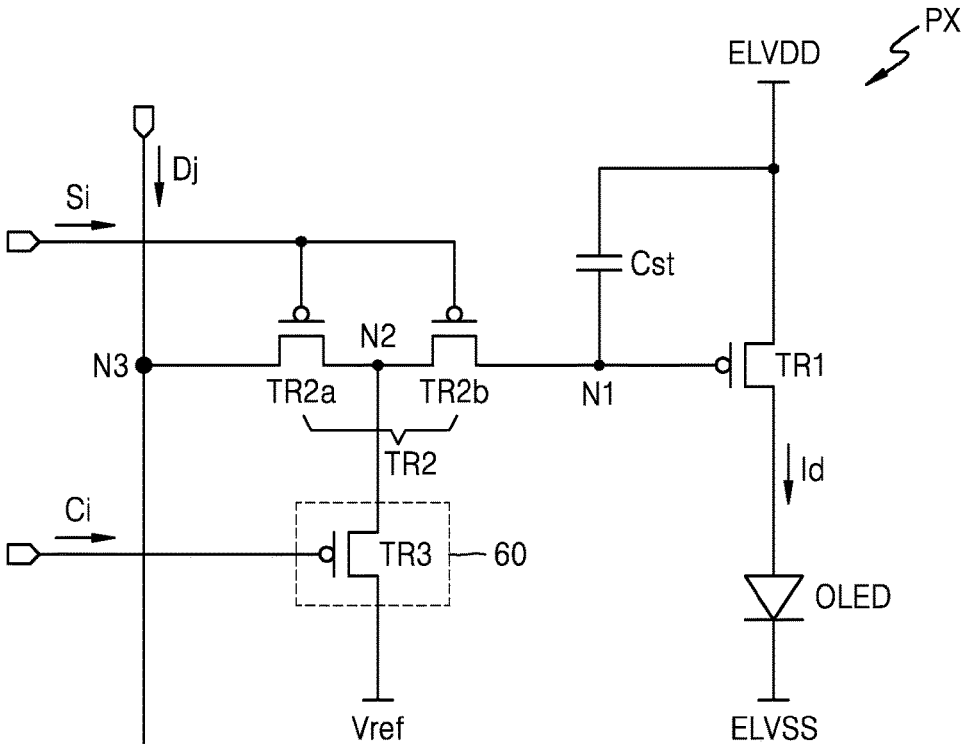
FIG. 3 is a block diagram of another exemplary embodiment of a pixel.
Figure 4:
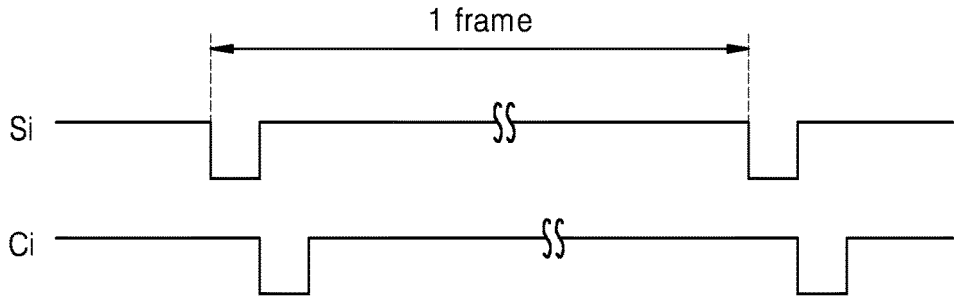
FIG. 4 illustrates an operation timing diagram of the pixel shown in FIG. 3.

FIG. 3 is a block diagram of a pixel PX according to another exemplary embodiment. FIG. 4 illustrates an operation timing diagram of the pixel PX shown in FIG. 3.

Referring to FIG. 3, the pixel PX may include the OLED, the first and second transistors TR1 and TR2, the storage capacitor Cst, and the voltage level changer 60. The voltage level changer 60 may include a third transistor TR3.

The first transistor TR1 may include a gate connected to a first node N1, a source to which a first driving voltage ELVDD is applied, and a drain connected to an anode of the OLED. The first driving voltage ELVDD may have a substantially constant level in a light emission period of the OLED. The first transistor TR1 may supply driving current Id to the OLED according to a voltage of the gate of the first transistor TR1. A magnitude of the driving current Id may be controlled by a gate voltage of the first transistor TR1. The first transistor TR1 may be referred to as a driving transistor.

The storage capacitor Cst is connected between the first node N1 and the source of the first transistor TR1, and maintains a gate-source voltage of the first transistor TR1 constant. Since a source voltage of the first transistor TR1 has a substantially constant level in a light emission period of the OLED, the storage capacitor Cst may maintain a gate voltage of the first transistor TR1 constant in the light emission period that comes after a data write period. Resultantly, the first transistor TR1 may supply constant driving current Id to the OLED in the light emission period, and the OLED may emit light with constant luminance.

The second transistor TR2 may be connected between the first node N1 and a third node N3. The third node N3 may be connected to a data line via which a data voltage Dj is transmitted. The second transistor TR2 may be controlled by a first control signal Si. The first control signal Si may be transmitted to the second transistor TR2 via a scanning line. The second transistor TR2 may transmit the data voltage Dj to the first node N1 in response to the first control signal Si. The data voltage Dj, transmitted to the first node N1, may be stored in the storage capacitor Cst, and thus, maintained in a frame. A period when the data voltage Dj is transmitted to the first node N1 via the second transistor TR2, and thus, stored in the storage capacitor Cst, may be referred to as a data write period. A period when the OLED emits light using driving current Id, output from the first transistor TR1 according to a voltage of the first node N1, may be referred to as a light emission period. The second transistor TR2 operates as a switching transistor that switches a connection between the first node N1 and the third node N3 in response to the first control signal Si, and may be referred to as a scanning transistor.

The second transistor TR2 may include the pair of transistors TR2*a* and TR2*b* which are controlled by the first control signal Si at a same time, and serially connected to each other. Gates of the pair of transistors TR2*a* and TR2*b* may be directly connected to each other, and the first control signal Si may be applied thereto. A node between the pair of transistors TR2*a* and TR2*b* may be defined as a second node N2. The pair of transistors TR2*a* and TR2*b* may be connected to each other via the second node N2.

In an exemplary embodiment, the second transistor TR2 may be a p-type MOSFET, for example. In addition to the second transistor TR2, the first transistor TR1 and the third transistor TR3 may also be p-type MOSFETs, for example. The second transistor TR2 may be turned off in response to a high-level first control signal Si, and turned on in response to a low-level first control signal Si. The second transistor TR2 may be turned off in response to a rising edge or a high-flat voltage of the first control signal Si. When the pair of transistors TR2*a* and TR2*b* is turned off, the second node N2 may be substantially floated. There may be parasitic capacitance between the second node N2 and gates of the transistors TR2*a* and TR2*b*. When the second node N2 is substantially floated, in case where electric potentials of the gates of the transistors TR2*a* and TR2*b* are changed, an electric potential of the second node N2 may be changed by the parasitic capacitance, according to the electric potentials of the gates of the transistors TR2*a* and TR2*b*. The second node N2 is coupled to a rising edge or a high flat voltage of the first control signal Si by the parasitic capacitance. When the second transistor TR2 is turned off, an electric potential of the second node N2 may increase in correspondence with the rising edge or the high flat voltage of the first control signal Si.

In an exemplary embodiment, a voltage of the first control signal Si may be changed, for example, by about 20 V, so as to control the second transistor TR2. When the second transistor TR2 is turned off, an electric potential of the second node N2, which is coupled to the first control signal Si, may increase, for example, by about 20 V. The electric potential of the second node N2 may be higher than an electric potential of the first node N1. Even when the transistor TR2*b* is turned off, an unignorable magnitude of turn-off current may flow from the second node N2 to the first node N1 and excessive stress may occur in the transistor TR2*b* due to a high voltage. Additionally, even when the other transistor TR2*a* is turned off, leak current may be generated from the second node N2 to the third node N3 and excessive stress may occur in the transistor TR2*a* due to a high voltage. Additionally, a voltage of the first node N1 may increase due to turn-off current from the second node N2, and the driving current Id may decrease due to an increase in a gate voltage of the first transistor TR1, and accordingly, luminance of the OLED may decrease.

In the above-described exemplary embodiment, the voltage level changer 60 may be connected to the second node N2. The voltage level changer 60 may change a voltage level of the second node N2 to the level of the reference voltage Vref after the second transistor TR2 is turned off. The voltage level changer 60 may include the third transistor TR3 for transmitting a reference voltage Vref to the second node N2 in response to the second control signal Ci. The reference voltage Vref may be set as being lower than a voltage level of the first node N1. The third transistor TR3 may be referred to as a voltage level changing transistor. The third transistor TR3 may have characteristics (e.g., an aspect ratio) substantially identical to those of the transistor TR2*b*. In another exemplary embodiment, the third transistor TR3 may have turn-off current higher than that of the transistor TR2*b*.

Referring to FIG. 4, the second control signal Ci may have a turn-on period later than that of the first control signal Si in a frame. The second control signal Ci periodically has a turn-on level, and defines a frame as being between periods in which there is a turn-on level. When a frame starts, the first control signal Si may have a turn-on level, and then, in case where the first control signal Si has a turn-off level, the second control signal Ci may have a turn-on level. Resultantly, the third transistor TR3 may be turned on after the second transistor TR2 is turned on and then turned off.

Thus, as the second transistor TR2 is turned off, a voltage level of the second node N2 is increased by a parasitic capacitor, and then, as the third transistor TR3 is turned on, the voltage level of the second node N2 may be changed to a level of the reference voltage Vref. Thus, a voltage between the first node N1 and the second node N2 decreases, and thus, turn-off current flowing from the second node N2 to the first node N1 may be decreased and a voltage change in the first node N1 may be decreased. Resultantly, a gate voltage of the first transistor TR1 may be maintained constant, a magnitude of driving current Id may be constant, and the OLED may emit light with constant luminance. Additionally, stress in the second transistor TR2 may be relieved due to a decrease in a voltage level between the first node N1 and the second node N2.

Figure 5:
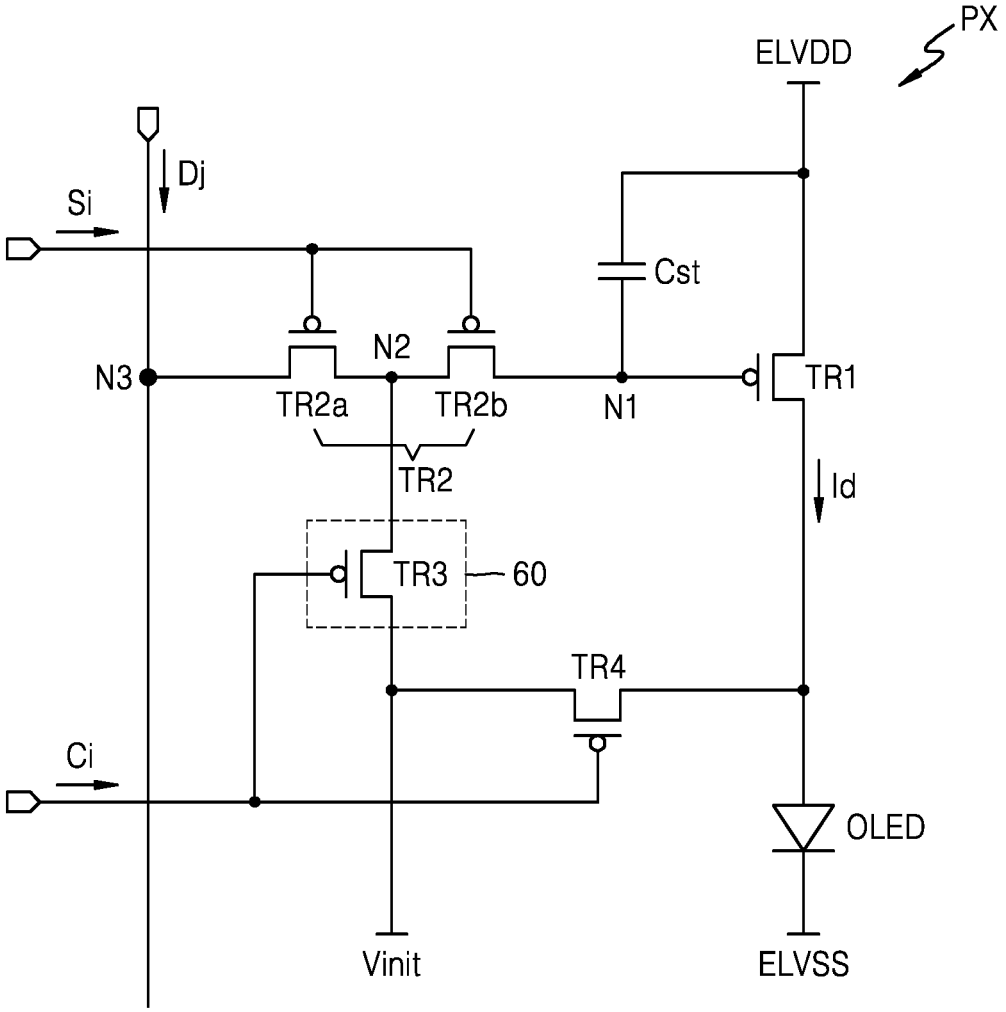
FIG. 5 is a block diagram of another exemplary embodiment of a pixel.

FIG. 5 is a block diagram of a pixel PX according to another exemplary embodiment.

Referring to FIG. 5, the pixel PX may include the OLED, the first and second transistors TR1 and TR2, a fourth transistor TR4, the storage capacitor Cst, and the voltage level changer 60. The voltage level changer 60 may include the third transistor TR3.

The pixel PX may be controlled according to the operation timing diagram shown in FIG. 4. According to an exemplary embodiment described with reference to FIG. 5, the pixel PX is substantially identical to the pixel PX according to an exemplary embodiment described with reference to FIG. 3, except that the pixel PX according to an exemplary embodiment described with reference to FIG. 5 further includes the fourth transistor TR4. Elements of the pixel PX, which are identical to those of the pixel PX described with reference to FIG. 3, are not described here again.

The fourth transistor TR4 may transmit an initialization voltage Vinit to an anode of the OLED, in response to a second control signal Ci. The initialization voltage Vinit may be applied to the anode of the OLED before a data write period, so as to prevent incorrect display of a full-black state and emission of dim light when an electric charge remains in the anode of the OLED. A difference between the initialization voltage Vinit and a second driving voltage ELVSS may be less than a threshold voltage of the OLED, so as to turn off the OLED. A period when the initialization voltage Vinit is transmitted to the anode of the OLED via the fourth transistor TR4 may be referred to as an anode initialization period. As shown in FIG. 4, the anode initialization period may be placed after the data write period. The initialization voltage Vinit may be same as the reference voltage Vref described with reference to FIG. 3, and may be set as being less than a voltage level of the first node N1.

As described above, the third transistor TR3 may operate in response to the second control signal Ci. In other words, after storing of an electric charge corresponding to a data signal in the storage capacitor Cst according to operation of the second transistor TR2 is finished, the third transistor TR3 may be turned on. In this case, a voltage level of the second node N2, which is coupled to a rising edge or a high-flat voltage of the first control signal Si, and thus, substantially floated, may greatly increase. As such, the voltage level of the second node N2 may be increased by a parasitic capacitor. Then, the voltage level of the second node N2 may be changed to a level of the initialization voltage Vinit as the third transistor TR3 is turned on by a rising edge or a high-flat voltage of the second control signal Ci. Thus, a voltage between the first node N1 and the second node N2 decreases, and thus, turn-off current flowing from the second node N2 to the first node N1 may decrease, and a change in a voltage of the first node N1 may decrease. Resultantly, a gate voltage of the first transistor TR1 may be maintained constant, and a magnitude of driving current Id may be constant, and the OLED may emit light with constant luminance. Additionally, stress in the second transistor TR2 may be relieved due to a decrease in a voltage level between the first node N1 and the second node N2.

Figure 6:
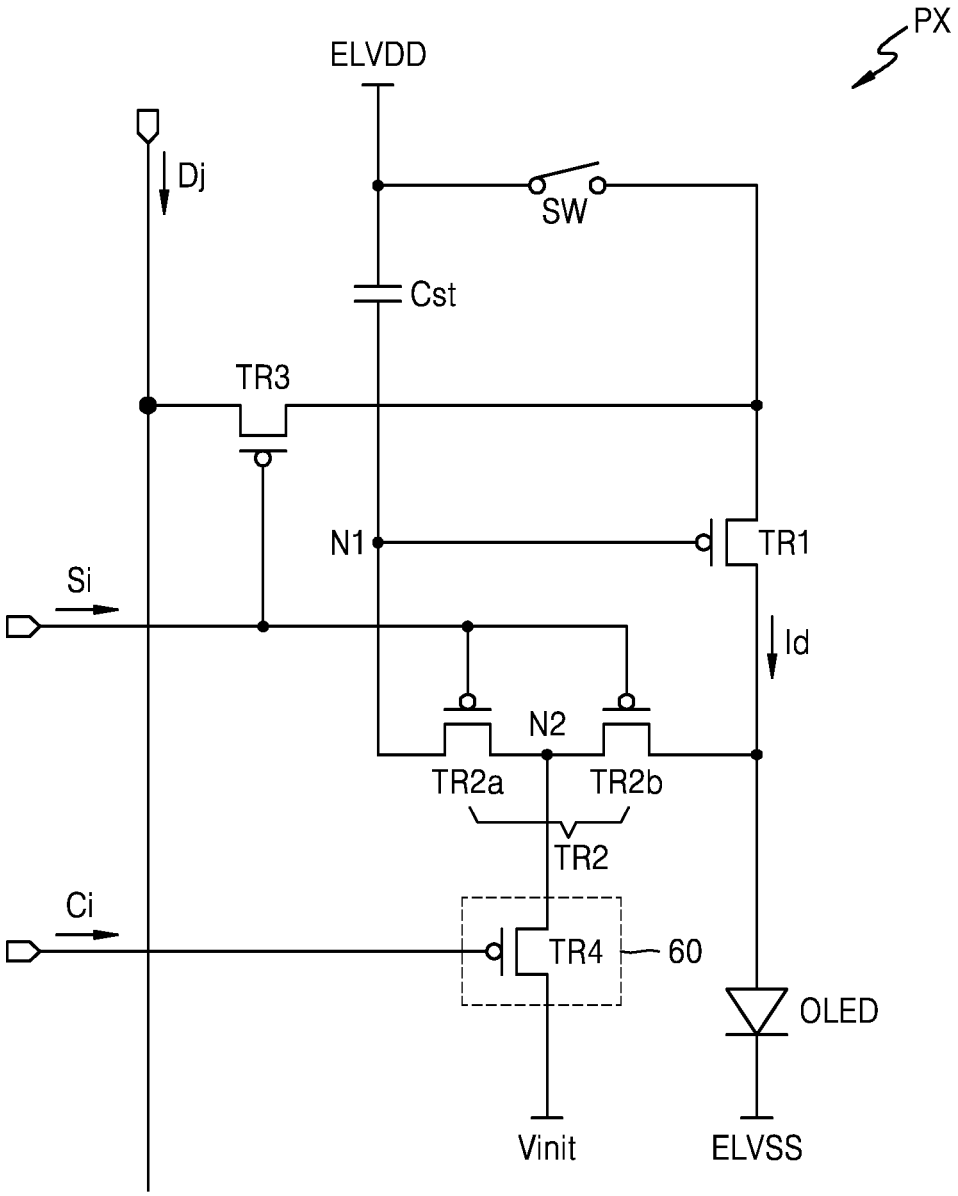
FIG. 6 is a block diagram of another exemplary embodiment of a pixel.

FIG. 6 is a block diagram of a pixel PX according to another exemplary embodiment.

Referring to FIG. 6, the pixel PX may include the OLED, the first through third transistors TR1 through TR3, the storage capacitor Cst, a switch SW, and a voltage level changer 60. The voltage level changer 60 may include the third transistor TR3. The voltage level changer 60 may include a fourth transistor TR4. The pixel PX may be controlled according to the operation timing diagram shown in FIG. 4.

The first transistor TR1 may include a gate connected to a first node N1, a source to which a first driving voltage ELVDD is applied via the switch SW, and a drain connected to an anode of the OLED. The first transistor TR1 may supply driving current Id to the OLED according to a voltage of the gate of the first transistor TR1. A magnitude of the driving current Id may be controlled by a gate voltage of the first transistor TR1. The first transistor TR1 may be referred to as a driving transistor.

The storage capacitor Cst may include a first electrode connected to the first node N1 and a second electrode to which a first driving voltage ELVDD is applied, and maintain a gate voltage of the first transistor TR1 constant. Since the first driving voltage ELVDD is applied to the source of the first transistor TR1 via the switch SW, the storage capacitor Cst may maintain a gate-source voltage of the first transistor TR1 constant in a light emission period that comes after the data write period.

The third transistor TR3 may be connected between a data line, to which a data voltage Dj is transmitted, and the source of the first transistor TR1. The third transistor TR3 may be controlled by a first control signal Si. The first control signal Si may be transmitted to the third transistor TR3 via a scanning line. The third transistor TR3 may transmit the data voltage Dj to the source of the first transistor TR1 in response to the first control signal Si. The third transistor TR3 may be referred to a scanning transistor.

The second transistor TR2 may be connected to the first node N1, that is, between the gate of the first transistor TR1 and the drain of the first transistor TR1. The second transistor TR2 may be controlled by the first control signal Si. The second transistor TR2 may diode-connect the first transistor TR1 by electrically connecting the gate of the first transistor TR1 to the drain of the first transistor TR1 in response to the first control signal Si. The second transistor TR2 may diode-connect the first transistor TR1 so that a compensation voltage, in which a threshold voltage of the first transistor TR1 is reflected, may be stored in the storage capacitor Cst. The second transistor TR2 may be referred to as a compensation transistor.

When the first control signal Si has a turn-on level, for example, a low level, the second transistor TR2 and the third transistor TR3 may be turned on. The data voltage Dj may be transmitted to the source of the first transistor TR1 via the third transistor TR3. In this case, the switch SW may be opened. The first transistor TR1 may be diode-connected using the second transistor TR2, and biased in a forward direction. Resultantly, a compensation voltage (Dj+Vth), in which a threshold voltage Vth of the first transistor TR1 is reflected in the data voltage Dj (the threshold voltage Vth has a minus (−) value), may be applied to the first node N1. Since the compensation voltage Dj+Vth is applied to the first electrode of the storage capacitor Cst and a first driving voltage is applied to the second electrode of the storage capacitor Cst, when the switch SW is off, a gate-source voltage of the first transistor TR1 may be a gate-source voltage (Dj+Vth-ELVDD). In the light emission period, the switch SW may be off and driving current Id, output from the first transistor TR1, may have a value proportional to a square of a value (Dj-ELVDD), that is, a value obtained by subtracting the threshold voltage Vth from the gate-source voltage (Dj+Vth-ELVDD). In other words, the driving current Id, determined regardless of the threshold voltage Vth of the first transistor TR1, may be output.

The second transistor TR2 may include the pair of transistors TR2*a* and TR2*b* which are controlled by the first control signal Si at a same time and serially connected to each other. Gates of the pair of transistors TR2*a* and TR2*b* may be directly connected to each other, and the first control signal Si may be applied thereto. A node between the pair of transistors TR2*a* and TR2*b* may be defined as a second node N2. The pair of transistors TR2*a* and TR2*b* may be connected to each other via the second node N2.

The second transistor TR2 may be a p-type MOSFET. In addition to the second transistor TR2, the first, third, or fourth transistor TR1, TR3, or TR4 may be a p-type MOSFET. The second transistor TR2 may be turned off in response to a rising edge or a high-flat voltage of the first control signal Si. When the pair of transistors TR2*a* and TR2*b* is turned off, the second node N2 may be substantially floated. There may be parasitic capacitance between the second node N2 and the gates of the transistors TR2*a* and TR2*b*. When the second node N2 is substantially floated, in case where electric potentials of the gates of the transistors TR2*a* and TR2*b* are changed, an electric potential of the second node N2 may be changed by the parasitic capacitance according to the electric potentials of the gates of the transistors TR2*a* and TR2*b*. The second node N2 is coupled to a rising edge or a high flat voltage of the first control signal Si. When the second transistor TR2 is turned off, an electric potential of the second node N2 may increase in correspondence with the rising edge or the high flat voltage of the first control signal Si.

A voltage of the first control signal Si may be changed, for example, by about 20 V so as to control the second transistor TR2. When the second transistor TR2 is turned off, an electric potential of the second node N2, which is coupled to the first control signal Si, may increase, for example, by about 20 V. The electric potential of the second node N2 may be higher than an electric potential of the first node N1 and/or an anode of the light-emitting device. Accordingly, even when the second transistor TR2 is turned off, an unignorable magnitude of turn-off current may flow from the second node N2 to the first node N1 and/or the anode of the light-emitting device. Thus, excessive stress may occur in at least one of the transistors TR2*a* and TR2*b*. Additionally, an electric potential of the first node N1 may increase due to turn-off current from the second node N2, and the driving current Id may decrease due to an increase in a gate voltage of the first transistor TR1. Also, luminance of the OLED may decrease.

In the above-described exemplary embodiment, the voltage level changer 60 may be connected to the second node N2. The voltage level changer 60 may change a voltage level of the second node N2 after the second transistor TR2 is turned off. The voltage level changer 60 may include a fourth transistor TR4 for transmitting an initialization voltage Vinit to the second node N2 in response to the second control signal Ci. The initialization voltage Vinit may be set as being lower than a voltage level of the first node N1. The fourth transistor TR4 may be referred to as a voltage level changing transistor. The fourth transistor TR4 may have characteristics (e.g., an aspect ratio) substantially identical to those of the transistor TR2*a*. In another exemplary embodiment, the fourth transistor TR4 may have turn-off current higher than that of the transistor TR2*a*.

As shown in the operation timing diagram in FIG. 4, the second control signal Ci may have a turn-on period later than that of the first control signal Si in a frame. In a frame, the fourth transistor TR4 may be turned on after the second transistor TR2 is turned on then turned off.

Thus, as the second transistor TR2 is turned on, a voltage level of the second node N2 may be increased by the parasitic capacitor. Then, the voltage level of the second node N2 may be changed to a level of the initialization voltage Vinit as the fourth transistor TR4 is turned on. Thus, a voltage between the first node N1 and the second node N2 decreases, turn-off current flowing from the second node N2 to the first node N1 may decrease, and a voltage change in the first node N1 may decrease. Resultantly, the gate voltage of the first transistor TR1 may be maintained constant, and a magnitude of driving current Id may be constant, and the OLED may emit light with constant luminance. Additionally, stress in the second transistor TR2 may be relieved due to a decrease in a voltage level between the first node N1 and the second node N2.

Figure 7:
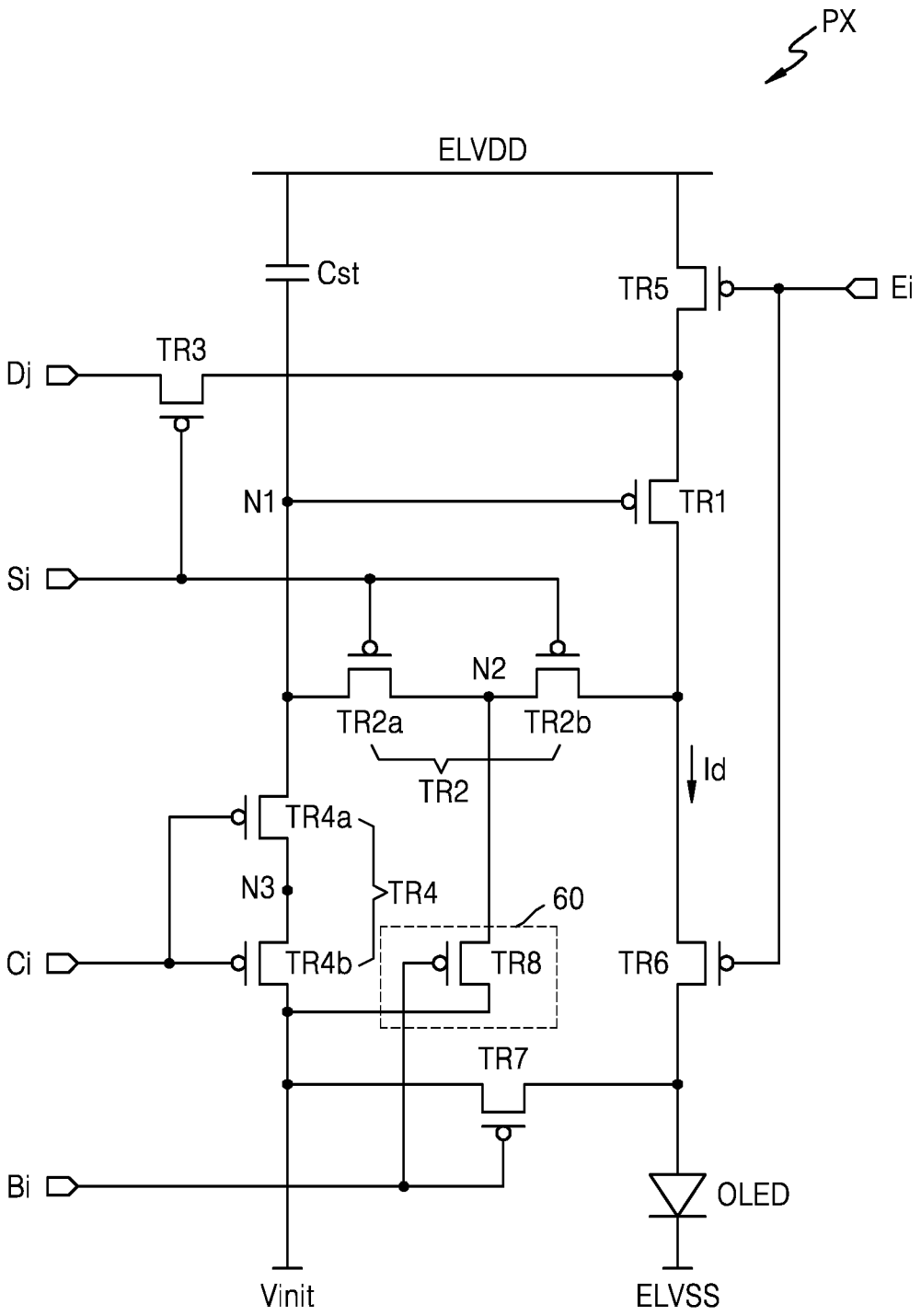
FIGS. 7 through 9 are block diagrams of another exemplary embodiment of a pixel.
Figure 8:
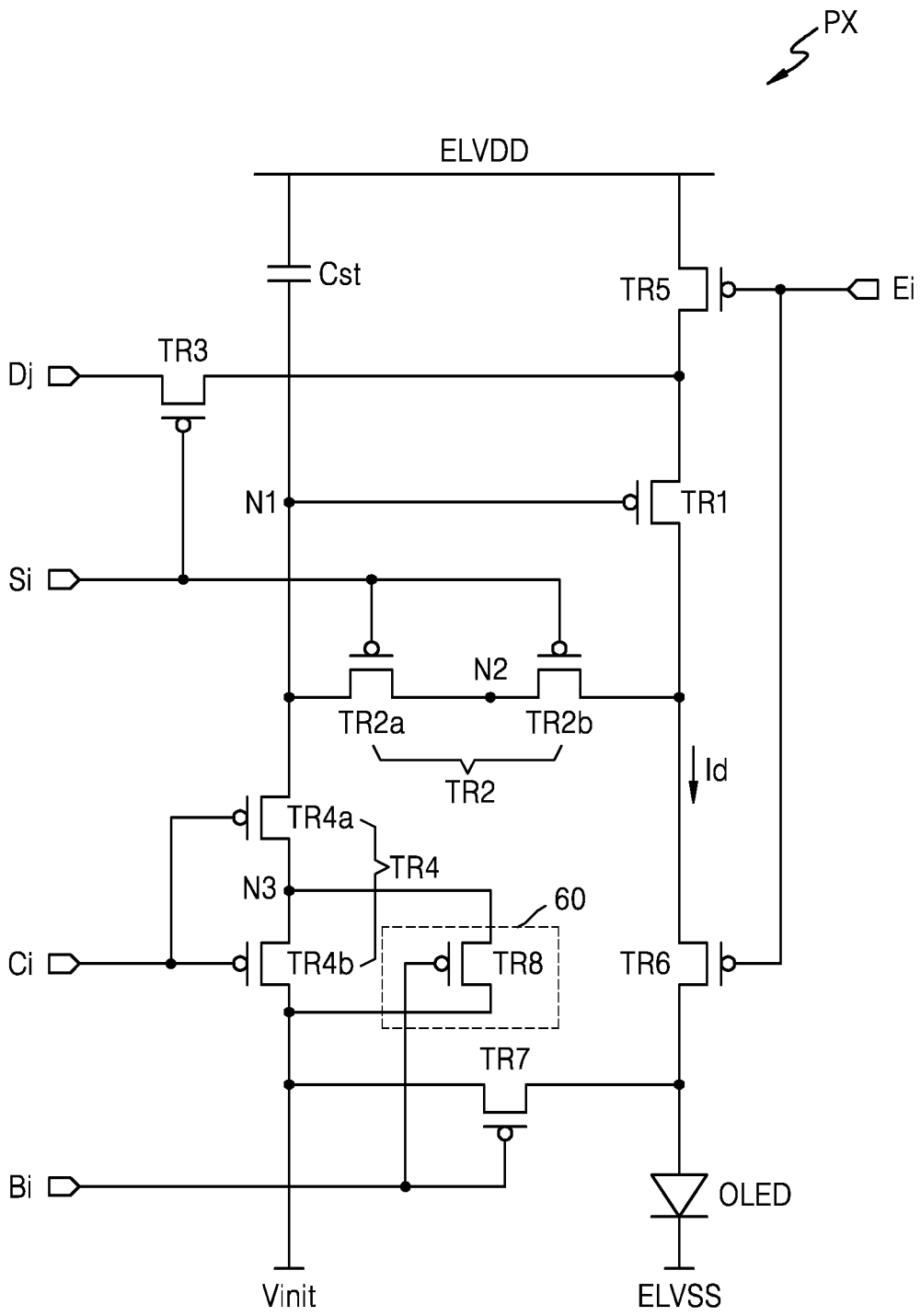
Figure 9:
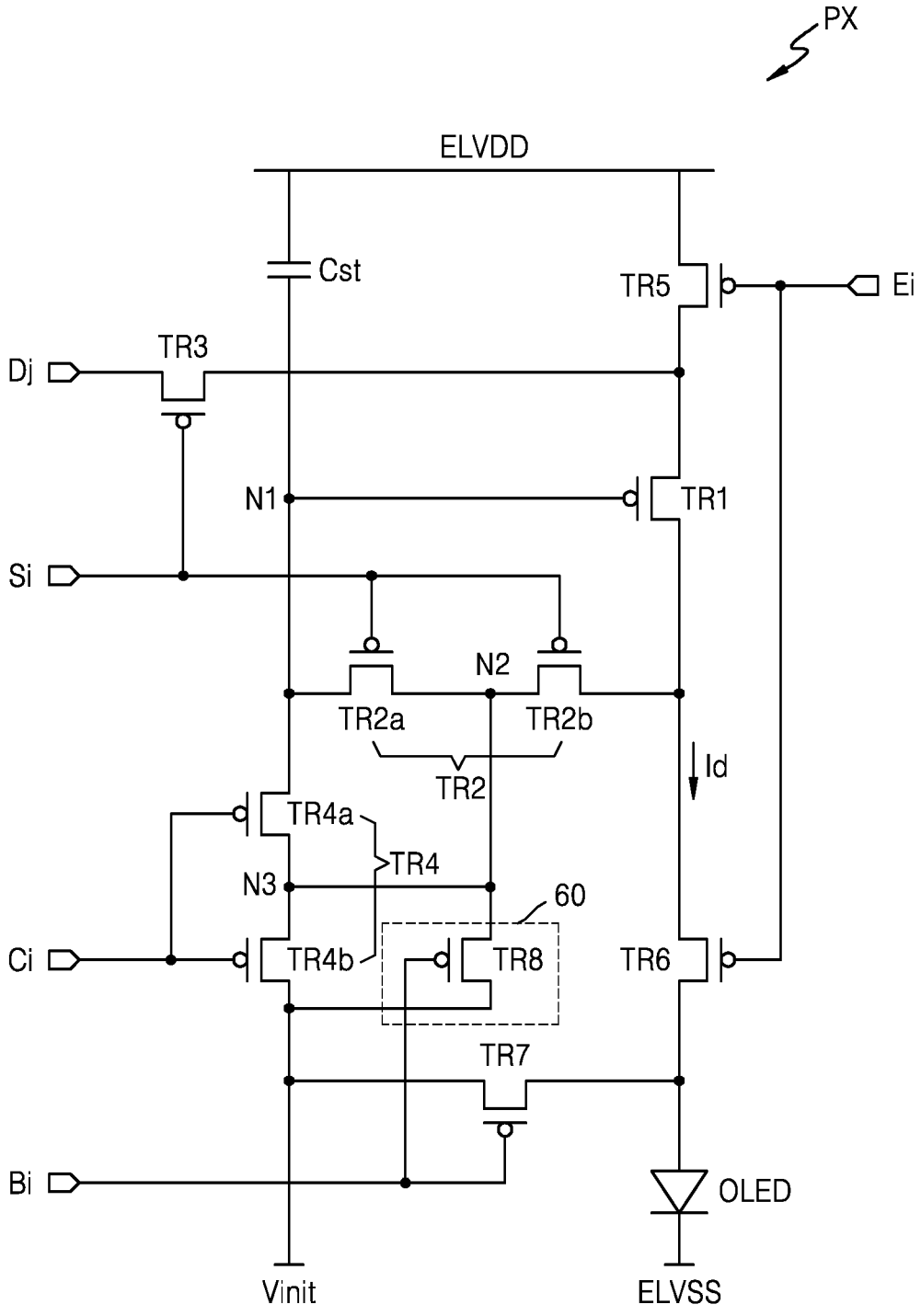
Figure 10:
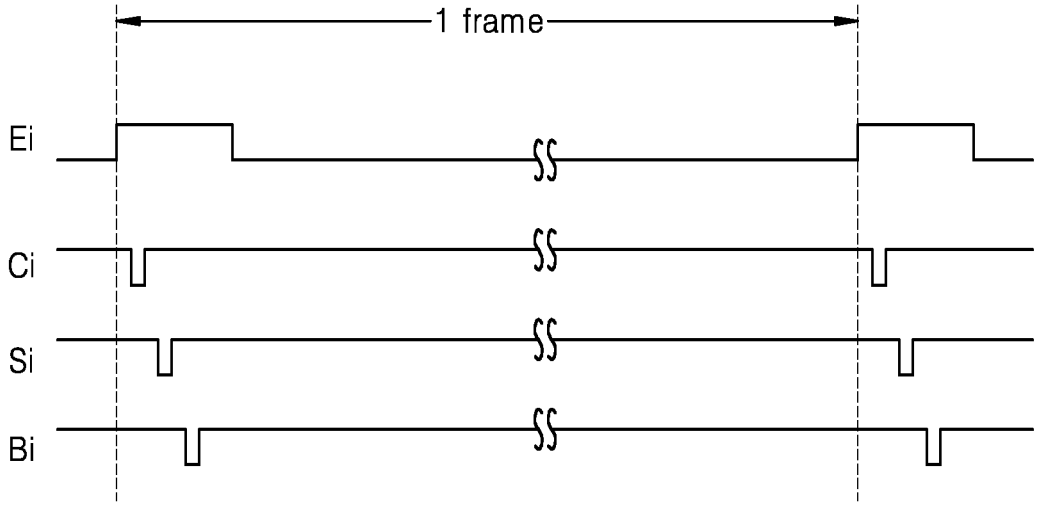
FIG. 10 illustrates an operation timing diagram of the pixel shown in FIGS. 7 through 9.

FIGS. 7 through 9 are block diagrams of a pixel according to another exemplary embodiment. FIG. 10 illustrates an operation timing diagram with respect to the pixel shown in FIGS. 7 through 9.

Referring to FIG. 7, the pixel PX may include the OLED, first through seventh second transistors TR1 through TR7, the storage capacitor Cst, and the voltage level changer 60. The first through third transistors TR1 through TR3 and the storage capacitor Cst included in the pixel PX may be substantially identical to those according to the exemplary embodiment described with reference to FIG. 6.

The first transistor TR1 may include a gate connected to the first node N1, a source to which a first driving voltage ELVDD is applied via the fifth transistor TR5, and a drain connected to an anode of the OLED via the sixth transistor TR6. The first transistor TR1 may supply driving current Id to the OLED according to a voltage of the gate of the first transistor TR1. A magnitude of the driving current Id may be controlled by a gate voltage of the first transistor TR1. The first transistor TR1 may be referred to as a driving transistor.

The storage capacitor Cst may include a first electrode connected to the first node N1 and a second electrode to which a first driving voltage ELVDD is applied, and maintain the gate voltage of the first transistor TR1 constant.

The third transistor TR3 may be connected between a data line, to which a data voltage Dj is transmitted, and the source of the first transistor TR1. The third transistor TR3 may be controlled by a first control signal Si transmitted via a scanning line. The third transistor TR3 may transmit the data voltage Dj to the source of the first transistor TR1 in response to the first control signal Si. The third transistor TR3 may be referred to a scanning transistor.

The second transistor TR2 may be connected between the gate of the first transistor TR1 and the drain of the first transistor TR1. The second transistor TR2 may be controlled by the first control signal Si. The second transistor TR2 may diode-connect the first transistor TR1 by electrically connecting the gate of the first transistor TR1 to the drain of the first transistor TR1 in response to the first control signal Si. The second transistor TR2 may diode-connect the first transistor TR1 so that a compensation voltage, in which a threshold voltage of the first transistor TR1 is reflected, may be stored in the storage capacitor Cst. The second transistor TR2 may be referred to as a compensation transistor. The second transistor TR2 may include the pair of transistors TR2*a* and TR2*b*, which are serially connected to each other. The pair of transistors TR2*a* and TR2*b* may be controlled by the first control signal Si at a same time, and connected to each other via the second node N2.

The fourth transistor TR4 may be connected between the first node N and a voltage source of the initialization voltage Vinit. The fourth transistor TR4 may be controlled by a second control signal Ci. The fourth transistor TR4 may fully turn the first transistor TR1 on by applying the initialization voltage Vinit to the first node N1 in response to the second control signal Ci. The initialization voltage Vinit may be set as a voltage that may fully turn the first transistor TR1 on. The fourth transistor TR4 may be referred to as a gate initialization transistor. The fourth transistor TR4 may include a pair of transistors TR4*a* and TR4*b*, which are serially connected to each other. The pair of transistors TR4*a* and TR4*b* may be controlled by a second control signal Ci at a same time, and connected to each other via the third node N3.

The fifth transistor TR5 may be connected between a source of the first transistor TR1 and a voltage source of a first driving voltage ELVDD. The fifth transistor TR5 may be controlled by a fourth control signal Ei. The fifth transistor TR5 may apply the first driving voltage ELVDD to the first transistor TR1 in response to a fourth control signal Ei so that the first transistor TR1 generates driving current Id.

The sixth transistor TR6 may be connected between a drain of the first transistor TR1 and the OLED. The sixth transistor TR6 may be controlled by the fourth control signal Ei. The sixth transistor TR6 may connect the first transistor TR1 to the OLED in response to the fourth control signal Ei so that the driving current Id is provided to the OLED by the first transistor TR1. The fifth and sixth transistors TR5 and TR6 may be referred to as a light emission control transistor.

The seventh transistor TR7 may be connected between the OLED and a voltage source of the initialization voltage Vinit. The seventh transistor TR7 may be controlled by a third control signal Bi. The seventh transistor TR7 may turn the OLED off by applying the initialization voltage Vinit to the anode of the OLED in response to the third control signal Bi. A difference between the initialization voltage Vinit and the second driving voltage ELVSS may be lower than a threshold voltage of the OLED, so that the OLED is turned off. The seventh transistor TR7 may be referred to as an anode initialization transistor.

As shown in FIG. 7, the first through seventh transistors TR1 through TR7 may be p-type MOSFETs, for example. However, exemplary embodiments are not limited thereto, and at least one of the first through seventh transistors TR1 through TR7 may be an n-type MOSFET.

Referring to FIG. 10, an operation timing diagram of first through fourth control signals Si, Ci, Ei, and Bi in a frame may be shown. Hereinafter, as shown in FIG. 7, the first through seventh transistors TR1 through TR7 are assumed as p-type MOSFETs.

As an example of an operation, when the fourth control signal Ei shifts to a turn-off level (a high level), the second control signal Ci, the first control signal Si, and the third control signal Bi may sequentially have a period of a turn-on level. After the third control signal Bi shifts to the turn-off level (the high level), the fourth control signal Ei may shift to the turn-on level (a low level).

While the fourth control signal has the turn-off level, the fifth and sixth transistors TR5 and TR6, controlled by the fourth control signal Ei, may be turned off. As the first driving voltage ELVDD is not applied to the first transistor TR1 and the first transistor TR1 and the OLED are disconnected from each other, the OLED may not emit light. A period when the fourth control signal Ei has a turn-off level may be referred to as a non-light emission period. Conversely, a period when the fourth control signal Ei has a turn-on level may be referred to as a light emission period.

While the second control signal Ci is at a turn-on level, the fourth transistor TR4 controlled by the second control signal Ci may be turned on. As the initialization voltage Vinit is applied to the gate of the first transistor TR1, the first transistor TR1 may be fully turned on. A period when the second control signal Ci is at a turn-on level may be referred to as a gate initialization period.

While the first control signal Si is at a turn-on level, the second and third transistors TR2 and TR3, controlled by the first control signal Si, may be turned on. The data voltage Dj is applied to a source of the first transistor TR1 via the third transistor TR3, and the first transistor TR1 may be diode-connected via the second transistor TR2. A compensation voltage in which a threshold voltage of the first transistor TR1 is reflected in the data voltage Dj is applied to the first node N1, and the compensation voltage may be stored in the storage capacitor Cst. A period when the first control signal Si is at a turn-on level may be referred to as a data write period. The threshold voltage of the first transistor TR1 may be compensated by a circuit operation in the data write period.

While the third control signal Bi is at a turn-on level, the seventh transistor TR7, controlled by the third control signal Bi, may be turned on. The initialization voltage Vinit is applied to an anode of the OLED using the seventh transistor TR7, and the OLED may be turned off. A period when the third control signal Bi is at a turn-on level may be referred to as an anode initialization period.

In the non-light-emitting period, a gate initialization period, a data write period, and an anode initialization period may be sequentially performed. In the light-emission period, the first transistor TR1 provides driving current Id, corresponding to a data voltage Dj, to the OLED according to a compensation voltage stored in the storage capacitor Cst, and the OLED may emit light with luminance corresponding to the data voltage Dj.

Referring back to FIG. 7, the second and third transistors TR2 and TR3 may be turned off in response to a rising edge or a high flat voltage of a first control signal Si, at a time point when the data write period ends. When the transistors TR2*a* and TR2*b* are turned off, the second node N2 may be substantially floated. There may be parasitic capacitance between the second node N2 and gates of the first and second transistors TR2*a* and TR2*b*. When the second node N2 is substantially floated, in case where electric potentials of the gates of the first and second transistors TR2*a* and TR2*b* are changed, an electric potential of the second node N2 may be changed by the parasitic capacitance, according to the electric potentials of the gates of the transistors TR2*a* and TR2*b*. The second node N2 is coupled to a rising edge or a high flat voltage of the first control signal Si. When the second transistor TR2 is turned off, an electric potential of the second node N2 may increase in correspondence with the rising edge or the high flat voltage of the first control signal Si.

In an exemplary embodiment, a voltage of the first control signal Si may be changed, for example, by about 20 V so as to control the second transistor TR2, for example. When the second transistor TR2 is turned off, an electric potential of the second node N2, coupled to the first control signal Si, may increase by about 20 V, for example. The electric potential of the second node N2 may be higher than an electric potential of the first node N1. Accordingly, even when the second transistor TR2 is turned off, an ignorable magnitude of turn-off current may flow from the second node N2 to the first node N1 and/or an anode of a light-emitting device. Thus, excessive stress may occur in at least one of the transistors TR2*a* and TR2*b*. Additionally, an electric potential of the first node N1 may increase due to turn-off current from the second node N2, and the driving current Id may decrease due to an increase in a gate voltage of the first transistor TR1, and accordingly, luminance of the OLED may decrease.

In the above-described exemplary embodiment, the voltage level changer 60 may be connected to the second node N2. The voltage level changer 60 may change a voltage level of the second node N2 after the second transistor TR2 is turned off. The voltage level changer 60 may include an eighth transistor TR8 for transmitting an initialization voltage Vinit to the second node N2 in response to a third control signal Bi. The initialization voltage Vinit may be set as being lower than a voltage level of the first node N1. The eighth transistor TR8 may be referred to as a voltage level changing transistor. The eighth transistor TR8 may have characteristics (e.g., an aspect ratio) substantially identical to those of the transistor TR2*a*. In another exemplary embodiment, the eighth transistor TR8 may have turn-off current higher than that of the transistor TR2*a*.

As shown in the operation timing diagram in FIG. 10, the third control signal Bi may have a turn-on period later than that of the first control signal Si in a frame. Accordingly, in a frame, the eighth transistor TR8 may be turned on after the second transistor TR2 is turned on and then turned off.

Thus, as the second transistor TR2 is turned off, a voltage level of the second node N2 may be increased by the parasitic capacitor. Then, the voltage level of the second node N2 may be changed to a level of the initialization voltage Vinit as the fourth transistor TR4 is turned on. Accordingly, a voltage between the first node N1 and the second node N2 decreases, and thus, turn-off current flowing from the second node N2 to the first node N1 may decrease and a voltage change in the first node N1 may be reduced. Resultantly, the gate voltage of the first transistor TR1 may be maintained constant, and a magnitude of driving current Id may be constant, and the OLED may emit light with constant luminance. Additionally, stress in the second transistor TR2 may be relieved due to a decrease in a voltage level between the first node N1 and the second node N2.

Referring to FIG. 8, the voltage level changer 60 may be connected to the third node N3. In this case, the voltage level changer 60 may change a voltage level of the third node N3 after the fourth transistor TR4 is turned off. The voltage level changer 60 may include an eighth transistor TR8 for transmitting an initialization voltage Vinit to the third node N3 in response to the third control signal Bi. The initialization voltage Vinit may be set as being lower than a voltage level of the first node N1. The eighth transistor TR8 may be referred to as a voltage level changing transistor. The eighth transistor TR8 may have characteristics (e.g., an aspect ratio) substantially identical to those of the transistor TR4*b*. In another exemplary embodiment, the eighth transistor TR8 may have turn-off current higher than that of the transistor TR4*a*.

As shown in the operation timing diagram in FIG. 10, the third control signal Bi may have a turn-on period later than that of the second control signal Ci in a frame. Accordingly, in a frame, the eighth transistor TR8 may be turned on after the fourth transistor TR4 is turned on and then turned off.

Thus, as the fourth transistor TR4 is turned off, a voltage level of the third node N3 may be increased by the parasitic capacitor. Then, the voltage level of the third node N3 may be changed to a level of the initialization voltage Vinit as the eighth transistor TR8 is turned on. Accordingly, a voltage between the first node N1 and the third node N3 decreases, turn-off current flowing from the third node N3 to the first node N1 may decrease, and a voltage change in the first node N1 may be reduced. Resultantly, the gate voltage of the first transistor TR1 may be maintained constant, a magnitude of driving current Id may be constant, and the OLED may emit light with constant luminance. Additionally, stress in the fourth transistor TR4 may be relieved due to a decrease in a voltage level between the first node N1 and the third node N3.

Referring to FIG. 9, the voltage level changer 60 may be connected to both the second node N2 and the third node N3. In this case, the voltage level changer 60 may change a voltage level of the second node N2 and the third node N3 after both the second transistor TR2 and the fourth transistor TR4 are turned off. The voltage level changer 60 may include the eighth transistor TR8 for transmitting an initialization voltage Vinit to the second node N2 and the third node N3 in response to the third control signal Bi. The initialization voltage Vinit may be set as being lower than a voltage level of the first node N1. The eighth transistor TR8 may be referred to as a voltage level changing transistor. The eighth transistor TR8 may have characteristics (e.g., an aspect ratio) substantially identical to those of the transistor TR2*a* included in the second transistor TR2 and the transistor TR4*a* included in the fourth transistor TR4. In another exemplary embodiment, the eighth transistor TR8 may have turn-off current higher than that of the transistor TR2*a* included in the second transistor TR2 and the transistor TR4*a* included in the fourth transistor TR4.

As shown in the operation timing diagram in FIG. 10, the third control signal Bi may have a turn-on period later than that of the first control signal Si and the second control signal Ci in a frame. Accordingly, in a frame, the eighth transistor TR8 may be turned on after the second transistor TR2 and the fourth transistor TR4 are turned on and then turned off.

Thus, a voltage level of the second node N2 is increased by the parasitic capacitor as the second transistor TR2 is turned off, and a voltage level of the third node N3 is increased by the parasitic capacitor as the fourth transistor TR4 is turned off. Then, as the eighth transistor TR8 is turned on, the voltage level of the second node N2 and the voltage level of the third node N3 may be changed to a level of the initialization voltage Vinit. Accordingly, a voltage between the first node N1 and the second node N2 decreases, a voltage between the first node N1 and the third node N3 decrease, and thus, turn-off current flowing from the second node N2 and the third node N3 to the first node N1 may decrease. Resultantly, a voltage change of the first node N1 may decrease, and the gate voltage of the first transistor TR1 may be maintained constant. In this case, a magnitude of driving current Id may be constant, and the OLED may emit light with constant luminance. Additionally, stress in the second transistor TR2 and the fourth transistor TR4 may be relieved due to a decrease in a voltage between the first node N1 and the second node N2 and a voltage between the second transistor TR2 and the fourth transistor TR4.

Figure 11:
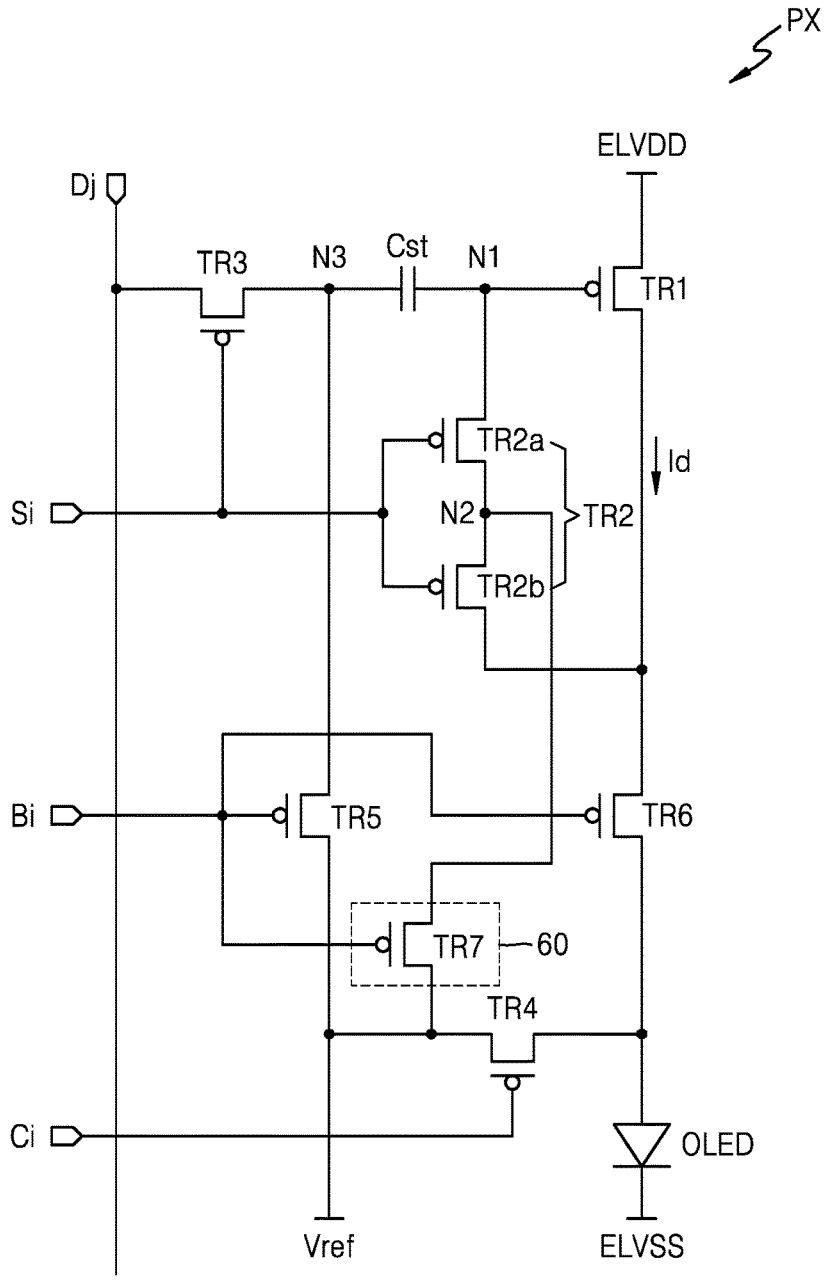
FIG. 11 is a block diagram of another exemplary embodiment of a pixel.

FIG. 11 is a block diagram of a pixel PX according to another exemplary embodiment.

Referring to FIG. 11, the pixel PX may include an OLED, first through sixth second transistors TR1 through TR6, the storage capacitor Cst, and the voltage level changer 60. The voltage level changer 60 may include a seventh transistor TR7. The pixel PX may be controlled according to a timing designed so that a second control signal Ci, a first control signal Si, and a third control signal Bi sequentially have a turn-off level period in a frame.

The first transistor TR1 may include a gate connected to the first node N1, a source to which a first driving voltage ELVDD is applied, and a drain connected to an anode of the OLED via the sixth transistor TR6. The first transistor TR1 may supply driving current Id to the OLED according to a voltage of the gate of the first transistor TR1. A magnitude of the driving current Id may be controlled by a gate voltage of the first transistor TR1. The first transistor TR1 may be referred to as a driving transistor.

The storage capacitor Cst may be connected between the first node N1 and a third node N3.

The second transistor TR2 may be connected between the gate of the first transistor TR1 and the drain of the first transistor TR1. The second transistor TR2 may be controlled by the first control signal Si. The second transistor TR2 may diode-connect the first transistor TR1 by electrically connecting the gate of the first transistor TR1 to the drain of the first transistor TR1 in response to the first control signal Si. The second transistor TR2 may diode-connect the first transistor TR1, and thus, apply a compensation voltage (ELVDD+Vth), obtained by reflecting a threshold voltage Vth (where Vth has a negative (−) value) of the first transistor TR1 in the first driving voltage ELVDD, to the first node N1. The second transistor TR2 may be referred to as a compensation transistor. The second transistor TR2 may include the pair of transistors TR2*a* and the TR2*b*, which are serially connected to each other. The pair of transistors TR2*a* and TR2*b* may be controlled by the first control signal Si at a same time, and connected to each other via a second node N2.

The third transistor TR3 may transmit a data voltage Dj to the third node N3 in response to the first control signal Si. The third transistor TR3 may be referred to a scanning transistor.

The fourth transistor TR4 may transmit a reference voltage Vref to an anode of the OLED, in response to the second control signal Ci. When the reference voltage Vref is applied to the anode of the OLED, the OLED may be turned off, and thus, initialized. A difference between the reference voltage Vref and a second driving voltage ELVSS may be less than a threshold voltage of the OLED. The fourth transistor TR4 may be referred to as an anode initialization transistor. The fourth transistor TR4 may include a pair of transistors which serially are connected to each other. In this case, the pair of transistors may be controlled by the second control signal Ci at a same time, and connected to each other via the fourth node N4.

The fifth transistor TR5 may apply the reference voltage Vref to the third node N3 in response to the third control signal Bi. When the reference voltage Vref is applied to the third node N3, a voltage corresponding to the data voltage Dj may be applied to a gate of the first transistor TR1. The fifth transistor TR5 may be referred to as a reference voltage applying transistor.

The sixth transistor TR6 may connect the first transistor TR1 to the OLED so that the driving current Id is provided from the first transistor TR1 to the OLED in response to the third control signal Bi. The sixth transistor TR6 may be referred to as a light emission control transistor.

As shown in FIG. 11, the first through sixth transistors TR1 through TR6 may be p-type MOSFETs, for example. However, exemplary embodiments are not limited thereto, and at least one of the first through sixth transistors TR1 through TR6 may be an n-type MOSFET.

In the above-described exemplary embodiment, the voltage level changer 60 may be connected to the second node N2. The voltage level changer 60 may change a voltage level of the second node N2 after the second transistor TR2 is turned off. The voltage level changer 60 may include a seventh transistor TR7 for transmitting a reference voltage Vref to the second node N2 in response to the third control signal Bi. The reference voltage Vref may be set as being lower than a voltage level of the first node N1. The seventh transistor TR7 may be referred to as a voltage level changing transistor. The seventh transistor TR7 may have characteristics (e.g., an aspect ratio) substantially identical to those of the second transistor TR2 (the transistors TR2*a* and TR2*b*). In another exemplary embodiment, the seventh transistor TR7 may have turn-off current higher than that of the transistors TR2*a* and TR2*b*.

The third control signal Bi may have a turn-on period later than that of the first control signal Si in a frame. Accordingly, in a frame, the seventh transistor TR7 may be turned on after the second transistor TR2 is turned on then turned off.

Thus, as the second transistor TR2 is turned off, a voltage level of the second node N2 may be increased by the parasitic capacitor. Then, the voltage level of the second node N2 may be changed to a level of the reference voltage Vref as the seventh transistor TR7 is turned on. Accordingly, a voltage between the first node N1 and the second node N2 decreases, and thus, turn-off current flowing from the second node N2 to the first node N1 may decrease and a voltage change in the first node N1 may be reduced. Resultantly, the gate voltage of the first transistor TR1 may be maintained constant, and a magnitude of driving current Id may be constant, and the OLED may emit light with constant luminance. Additionally, stress in the second transistor TR2 may be relieved due to a decrease in a voltage level between the first node N1 and the second node N2.

According to one or more exemplary embodiments described above, an organic light-emitting display apparatus including a pixel circuit in which voltages at both ends of a storage capacitor in a pixel are stably maintained may be provided. Additionally, according to one or more exemplary embodiments, an organic light-emitting display apparatus including a pixel circuit for relieving stress, which may be caused by a difference in voltages at both ends of a transistor, and reducing leak current, which may occur when the transistor is off, may be provided.

According to one or more exemplary embodiments described above, leak current that may be generated when a transistor is off may be reduced, and voltages at both ends of a storage capacitor in a pixel may be stably maintained. Accordingly, luminance of an OLED may be maintained constant in a frame constant. According to one or more exemplary embodiments, image quality characteristics of an organic light-emitting display apparatus may be enhanced.

The steps of all methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. For the sake of brevity, conventional electronics, control systems, software development and other functional exemplary embodiments of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be in a practical device. Moreover, no item or component is essential to the practice of the invention unless the element is specifically described as "essential" or "critical".

Therefore, the scope of the invention is defined not by the detailed description of the invention but by the appended claims, and all differences within the scope will be construed as being included in the invention.

It should be understood that exemplary embodiments described herein should be considered in a descriptive sense only and not for purposes of limitation. Descriptions of features or each exemplary embodiment should typically be considered as available for other similar features or other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. An organic light-emitting display apparatus comprising:

an organic light-emitting diode;

a driving transistor which includes a gate connected to a first node, and supplies driving current to the organic light-emitting diode according to a voltage of the gate;

a storage capacitor which is connected to the first node, and maintains a voltage of the first node constant;

a switching transistor connected to the first node, and comprising a pair of transistors which are turned on at a same time according to a first control signal, and serially connected to each other via a second node; and a voltage level changer which has a first terminal connected to the second node, and changes a voltage level of the second node to a reference voltage level after the switching transistor is turned off; and an anode initialization transistor connected between an anode of the organic light-emitting diode and a second terminal of the voltage level changer.

2. The organic light-emitting display apparatus of claim 1, wherein the switching transistor is turned off in response to at least one of a rising edge and a high flat voltage of the first control signal, and the second node is coupled to at least one of the rising edge and the high flat voltage of the first control signal, so that a voltage level of the second node increases when the switching transistor is turned off.

3. The organic light-emitting display apparatus of claim 1, wherein the switching transistor transmits a data voltage to the first node in response to the first control signal, and the voltage level changer comprises a voltage level changing transistor which changes a voltage level of the second node to a reference voltage level in response to a second control signal.

4. The organic light-emitting display apparatus of claim 3, wherein the voltage level changing transistor is turned on after the switching transistor is turned off in a frame.

5. The organic light-emitting display apparatus of claim 3, wherein the reference voltage level is set as being lower than a voltage level of the second node which increased when the switching transistor turned off.

6. The organic light-emitting display apparatus of claim 3, wherein the anode initialization transistor changes a voltage level of an anode of the organic light-emitting diode to the reference voltage level in response to the second control signal.

7. The organic light-emitting display apparatus of claim 1, wherein the driving transistor and the switching transistor comprise positive, negative, positive ("PNP")-type transistors.

8. The organic light-emitting display apparatus of claim 1, further comprising a scanning transistor which transmits a data voltage to a source of the driving transistor in response to the first control signal, wherein the switching transistor connects the gate of the driving transistor and a drain of the driving transistor to each other in response to the first control signal.

9. The organic light-emitting display apparatus of claim 8, further comprising a gate initialization transistor comprising a pair of transistors, which are turned on at a same time according to a second control signal and serially connected to each other via a third node, change a voltage level of the first node to the reference voltage level in response to the second control signal, and are turned off earlier than the switching transistor in a frame.

10. The organic light-emitting display apparatus of claim 9, wherein the anode initialization transistor changes a voltage level of an anode of the organic light-emitting diode to the reference voltage level in response to a third control signal, wherein the organic light-emitting display apparatus further comprises:

a pair of light-emitting control transistors which transmits a driving voltage to the driving transistor in response to a fourth control signal, and transmits the driving current from the driving transistor to the organic light-emitting diode, and wherein the second control signal, the first control signal, and the third control signal sequentially have a turn-on level, after the pair of light-emitting control transistors are turned off according to the fourth control signal having a turn-off level.

11. The organic light-emitting display apparatus of claim 9, wherein the voltage level changer comprises a voltage level changing transistor which changes a voltage level of the second node to the reference voltage level in response to a third control signal.

12. The organic light-emitting display apparatus of claim 11, wherein the voltage level changer electrically and directly connects the second node to the third node.

13. The organic light-emitting display apparatus of claim 10, wherein the voltage level changer comprises a voltage level changing transistor which changes a voltage level of the third node to the reference voltage level in response to the third control signal.

14. The organic light-emitting display apparatus of claim 1, further comprising a scanning transistor which transmits a data voltage to a third node in response to the first control signal, wherein the storage capacitor is connected between the first node and the third node, and the switching transistor connects the gate of the driving transistor to a drain of the driving transistor so as to compensate for a threshold voltage of the driving transistor in response to the first control signal.

15. The organic light-emitting display apparatus of claim 14, wherein the anode initialization transistor which changes a voltage level of an anode of the organic light-emitting diode to the reference voltage level in response to a second control signal, and wherein the organic light-emitting display apparatus further comprises:

a reference voltage applying transistor which changes a voltage level of the third node to the reference voltage level in response to a third control signal; and a light-emitting control transistor which transmits the driving current from the driving transistor to the organic light-emitting diode in response to the third control signal.

16. The organic light-emitting display apparatus of claim 15, wherein the voltage level changer changes a voltage level of the second node to the reference voltage level in response to the third control signal, and comprises a voltage level changing transistor which is turned on after the switching transistor is turned off.

17. An organic light-emitting display apparatus comprising:

an organic light-emitting diode;

a driving transistor which outputs driving current to the organic light-emitting diode;

a storage capacitor which charges a voltage corresponding to a data signal which is supplied via a data line;

a scanning transistor which transmits the data signal, supplied via the data line, to a source of the driving transistor in response to a first control signal;

first and second switching transistors which connects a gate of the driving transistor to a drain of the driving transistor, in response to the first control signal at a same time, and serially connected to each other via a connection node; and a voltage level changer which has a first terminal connected to the connection node, and changes a voltage level of the connection node to a reference voltage level after the first and second switching transistors are turned off; and an anode initialization transistor connected between an anode of the organic light-emitting diode and a second terminal of the voltage level changer.

18. The organic light-emitting display apparatus of claim 17, wherein the first and second switching transistors are turned off in response to at least one of a rising edge and a high flat voltage of the first control signal, and the connection node is coupled to at least one of the rising edge and the high flat voltage of the first control signal, so that a voltage level of the connection node increases when the first and second switching transistors are turned off.

19. The organic light-emitting display apparatus of claim 17, wherein the voltage level changer comprises a voltage level changing transistor which changes a voltage level of the connection node to a reference voltage level in response to a second control signal.

20. The organic light-emitting display apparatus of claim 19, wherein the voltage level changing transistor is turned on after the first and second switching transistors are turned off in a frame.

* * * * *